US005848603A

United States Patent [19]

Urban

[11] Patent Number: 5,848,603

[45] Date of Patent: Dec. 15, 1998

[54] ARM PIECE ASSEMBLY FOR CRUTCH

[75] Inventor: Ted F. Urban, Oshkosh, Wis.

[73] Assignee: Lamico, Inc., Oshkosh, Wis.

[21] Appl. No.: 666,609

[22] Filed: Jun. 18, 1996

[51] Int. Cl.[6] ..... A61H 3/02

[52] U.S. Cl. ..... 135/71; 135/73; 135/68

[58] Field of Search ..... 135/65, 68, 69, 135/71, 72, 73; 74/557, 558, 551.9

[56] References Cited

U.S. PATENT DOCUMENTS

| | | | |
|---|---|---|---|
| 233,824 | 10/1880 | Whittemore | 135/73 |
| 1,311,664 | 7/1919 | Pearl | 135/73 |
| 3,304,946 | 2/1967 | Lutes | 135/73 X |
| 3,730,198 | 5/1973 | Johnston et al. | 135/72 X |
| 4,637,414 | 1/1987 | Urban | 135/73 |
| 4,747,278 | 5/1988 | Roncelli et al. | 74/557 X |
| 4,837,892 | 6/1989 | Lo | 74/551.9 X |
| 5,351,701 | 10/1994 | Hsiao | 135/69 X |
| 5,458,145 | 10/1995 | Davis | 135/73 X |

*Primary Examiner*—Carl D. Friedman
*Assistant Examiner*—Winnie S. Yip
*Attorney, Agent, or Firm*—Andrus, Sceales, Starke & Sawall

[57] ABSTRACT

An improved arm piece assembly for a crutch comprising a hollow, thermoplastic blow-molded arm piece and an outer resilient covering molded to the outer surface of the arm piece. The inner side surface of the arm piece is located at a slight angle to the vertical, and is generally concave in the horizontal direction to more readily accommodate the rib-cage of the user. The bottom surface of the end piece is provided with a pair of recesses which receive the ends of the bows of the crutch. The recesses are reinforced by depressions that are formed in the side surfaces of the end piece adjacent the recesses. The bow ends are locked within the recesses by fasteners such as spiral nails, which are driven through the depressions in the side surfaces of the end piece into engagement with the bow ends.

11 Claims, 3 Drawing Sheets

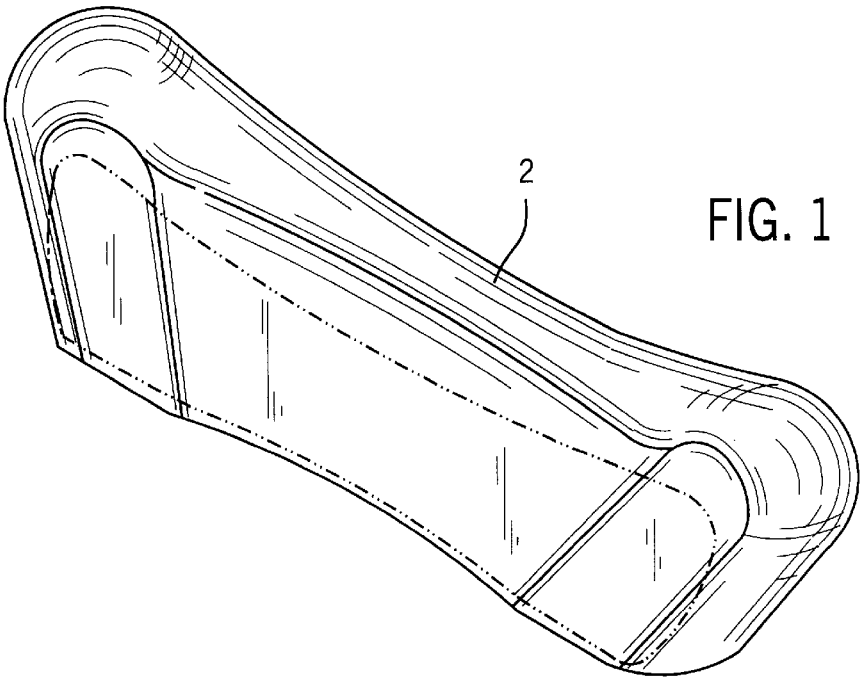
FIG. 1
FIG. 2
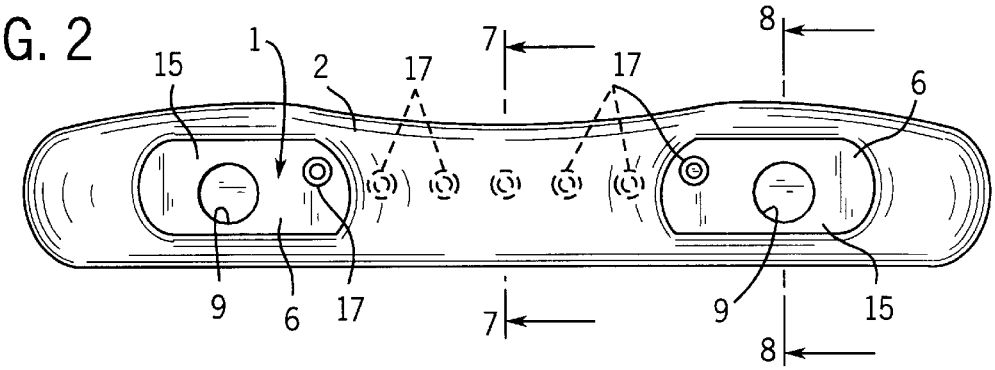
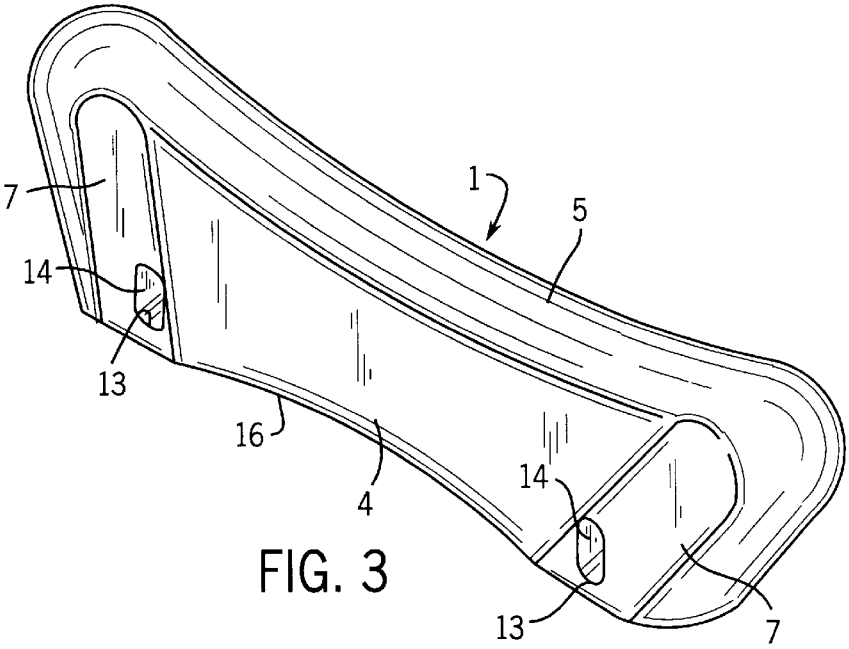
FIG. 3

ARM PIECE ASSEMBLY FOR CRUTCH

BACKGROUND OF THE INVENTION

The conventional arm piece assembly as used with a wood crutch is composed of a hardwood arm piece and an outer pad or cushion of a resilient polymeric material. In producing the arm piece, the hardwood stock, such as oak or maple, is initially cut to a size of approximately 1"×2"×8" and the opposite side surfaces of the blank are then planed or surfaced. The blank is then subjected to a series of shaping operations to provide the desired configuration. Following this, the shaped blank is sealed and subsequently a finish coating is applied to the arm piece. The finished arm piece must then be manually assembled with the outer pad or cushion. Due to the various woodworking operations, the finishing operations and the manual assembly with the outer pad, the production of the arm piece assembly requires considerable labor, and thus contributes substantially to the overall cost of the crutch.

The typical wood arm piece includes a pair of parallel side surfaces which are located perpendicular or normal to the bottom surface. The upper surface is concave and the ends of the arm piece flare outwardly and upwardly. The edges bordering the side surfaces and the top surface, as well as the edges bordering the side surfaces and the ends, are slightly rounded or radiused. While the edges bordering the parallel side surfaces and the top surface are rounded or radiused, the edges are relatively sharp, and even though they are covered with the outer cover, tend to irritate the rib cage of the user. Further, the central longitudinal portion of the end piece has a shallow depth of slightly more than one inch, which provides a limited bearing area against the rib cage.

SUMMARY OF THE INVENTION

The invention is directed to an improved arm piece assembly for a crutch. In general, the arm piece assembly includes a hollow, thermoplastic blow-molded arm piece, and an outer resilient covering or pad which is molded to the outer surface of the arm piece.

In the construction of the invention, the outer side surface of the arm piece, which faces away from the rib cage of the user, is generally normal or perpendicular to the bottom surface of the arm piece, while the inner side surface tapers upwardly and outwardly and is located at an angle of about 15°–20° with respect to the outer side surface. In addition, the central portion of the inner side surface is concave in a horizontal direction. The taper along with the concavity in the inner side surface that faces the user more readily accommodates the rib cage of the user, and prevents irritation to the rib cage during usage.

In addition, the arm piece of the invention has a greater vertical depth than the conventional wood arm piece, which results in greater surface area being applied to the rib cage and less pressure is applied through the top edge of the arm piece to the rib cage.

The bottom surface of the blow-molded arm piece is provided with a pair of recesses, each of which is bordered by a generally cylindrical recess wall. The upper ends of the bows of the crutch are received within the recesses. To reinforce the recesses, the side surfaces of the arm piece are formed with indentations which are located adjacent each recess. The indentations act to stiffen or reinforce the recess walls to minimize deflection of the arm piece during use of the crutch.

The bottom surface of the arm piece can also be provided with a series of wells or depressions which function to provide cooling during the blow-molding operation, as well as adding additional stiffness or rigidity to the arm piece.

To apply the outer cover or pad to the arm piece, the blow-molded arm piece is placed in a mold, and the resilient thermoplastic material is molded around the arm piece.

After molding of the outer cover, the bow ends of the crutch can be inserted into the recesses in the bottom surface of the end piece, and locked therein by driving fasteners, such as spiral nails, through the side surfaces of the arm piece and into engagement with the bow ends. The headless spiral nails can be driven through the outer covering, and the resilient covering will seal over the nail holes so that the nails are not visible in the final product.

The arm piece assembly of the invention is a strong, lightweight unit that is considerably less expensive to produce than the conventional wood arm piece.

Due to the fact that the inner side surface of the arm piece, which contacts the rib cage of the user, is contoured to accommodate the ribcage, there is less irritation to the rib cage through use of the crutch.

Other objects and advantages will appear during the course of the following description.

DESCRIPTION OF THE DRAWINGS

The drawings illustrate the best mode presently contemplated of carrying out the invention.

In the drawings:

FIG. 1 is a perspective view of the arm piece assembly of the invention;

FIG. 2 is a bottom view of the assembly shown in FIG. 1;

FIG. 3 is a perspective view of the blow molded arm piece;

DESCRIPTION OF THE ILLUSTRATED EMBODIMENT

FIGS. 1 and 2 illustrate the improved arm piece assembly of the invention, including a hollow, thermoplastic, blow-molded arm piece 1, and an outer resilient polymeric pad or covering 2 which is molded to the outer surface of arm piece 1.

Arm piece 1 can be produced by conventional blow molding techniques using a thermoplastic resin, such as polyethylene. In the completed state, the arm piece is hollow and has a generally uniform wall thickness.

Figure 4:
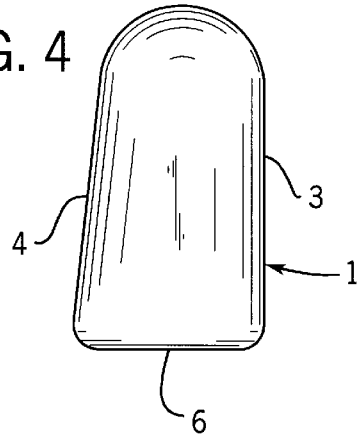
FIG. 4 is an end view of the arm piece shown in FIG. 3.

As shown in FIGS. 3–6, arm piece 1 includes an outer side surface 3 which in use faces away from the rib cage of the user, and an inner side surface 4 which faces toward the rib cage. The side surfaces 3 and 4 are connected together by a generally concave top surface 5 and a bottom surface 6. As shown in FIG. 4, bottom surface 6 is generally perpendicular or normal to the inner side surface 3.

Inner side surface 4 is formed with a pair of end portions 7 which lie on a common plane, and are located at an angle of about 15°–20°, and preferably about 18°, with respect to the outer surface 3. Central portion 8 of inner side surface 4, located between end portions 7, is concave to accommodate the rib cage of the user, and in practice, the concavity has a radius of about 8 inches. End portions 7, as well as central portion 8, are joined to the top surface 5 through rounded or radiused edges, as seen in FIG. 1.

Figure 6:
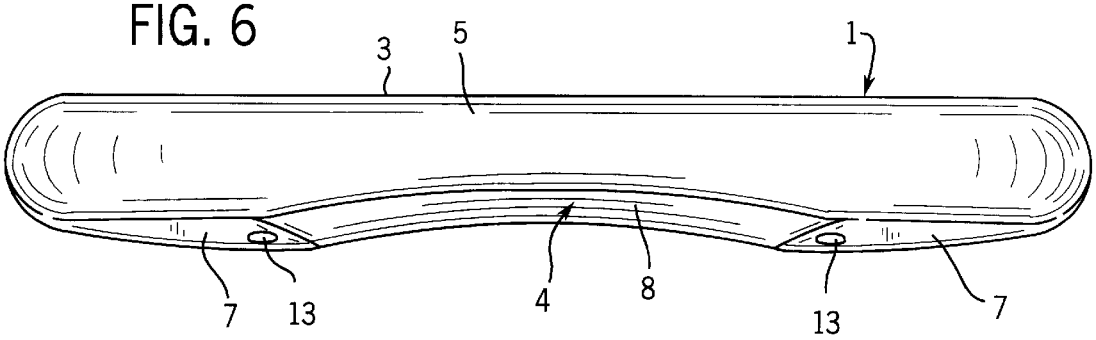
FIG. 6 is a top view of the arm piece.

As best shown in FIGS. 2 and 6, bottom surface 6 is provided with a pair of generally cylindrical recesses 9, which are adapted to receive the upper ends of the bows of the crutch. Each recess 9 is bordered by a generally cylindrical recess wall 10, and the bottom of each recess is closed off by a bottom wall 12.

Figure 8:
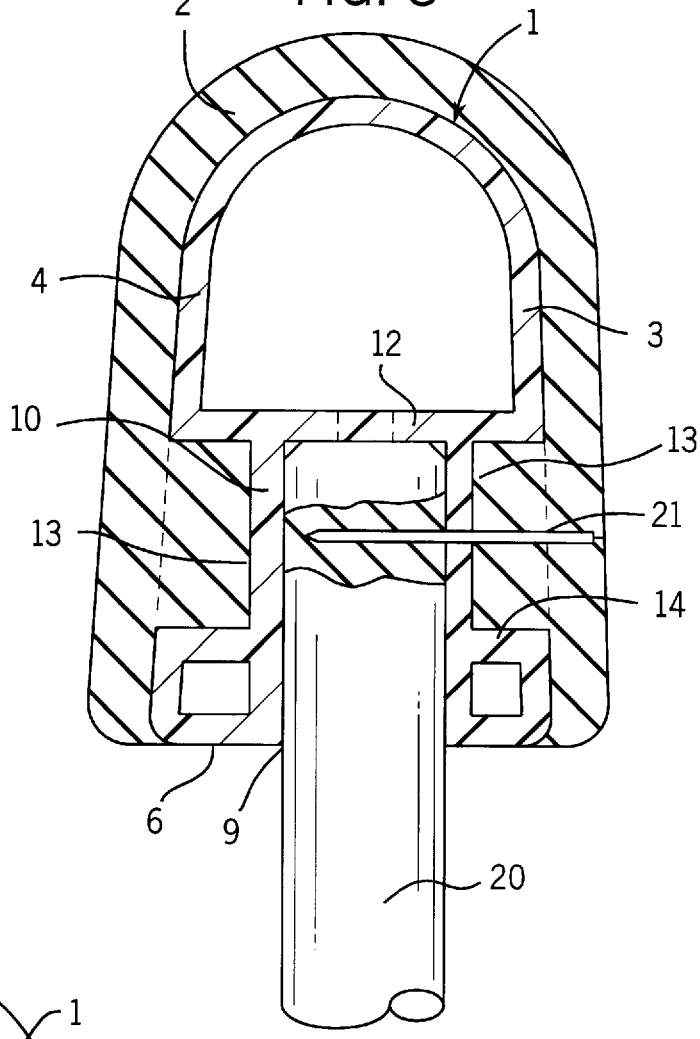
FIG. 8 is a section taken along line 8—8 of FIG. 2.

To provide reinforcement for the recesses 9 that receive the bow ends, each side surface 3 and 4 is provided with a pair of depressions or wells 13, which are located adjacent the recesses 9. As best shown in FIG. 8, each depression 13 is defined by a side wall 14 and the wall 10 of recess 9 forms the bottom of the depressions 13. The walls 14 serve to connect the side surfaces 3 and 4 with each recess wall 10, and thus serve to stiffen or reinforce the recesses 9.

Figure 5:
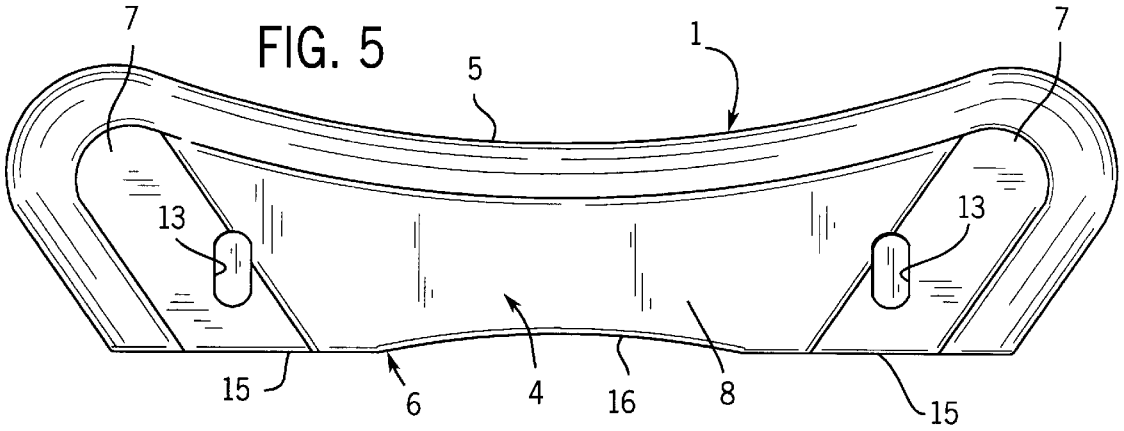
FIG. 5 is a side elevation of the arm piece.

As illustrated in FIG. 5, bottom surface 6 is provided with a pair of end portions 15, which lie in a common plane, and border a central concave portion 16.

Figure 7:
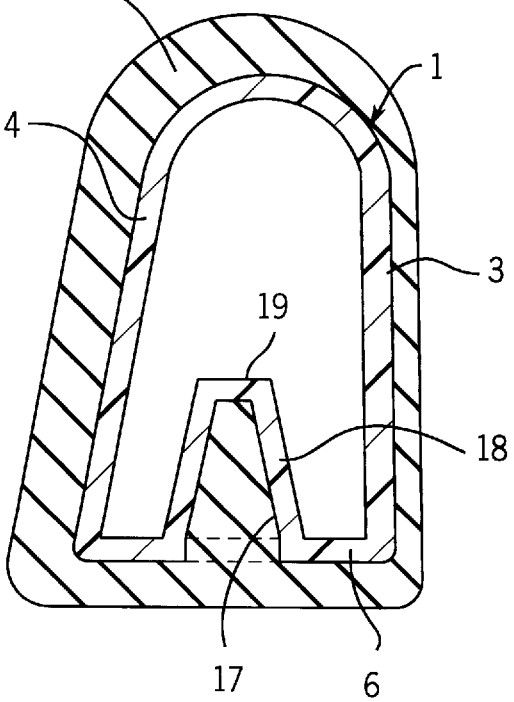
FIG. 7 is a section taken along line 7—7 of FIG. 2.

Bottom surface 6 can be formed with a series of small tapered indentations or recesses 17, each of which is bordered by a frusto-conical side wall 18 and a bottom 19, as seen in FIG. 7. The recesses 17 provide a cooling function during the blow-molding operation, and also serve to increase the stiffness or rigidity of the arm piece.

The outer pad or covering 2 can be molded using a thermoplastic resin, such as polyvinyl chloride, and is molded directly to the outer surface of arm piece 1. During molding, the covering material will tend to fill in the depressions 13 in side surfaces 3 and 4, as shown in FIG. 8, as well as filling in a number of the indentations 17 in bottom surface 6, as seen in FIG. 7. In the molding operation, the bottom surface 6 of the arm piece is located flatwise against the bottom of the mold, so that the plastic coating 2 will not be molded onto the end portions 15 of bottom surface 6 as seen in FIG. 2.

Suitable ribs or surface deviations can be provided in the sides of the covering 2.

As previously noted, the upper ends 20 of the bows of the crutch are adapted to be received within the recesses 9, as shown in FIG. 8. To lock the bow ends 20 within the recesses 9, fasteners 21, such as headless spiral nails, are driven through the depressions 13 and into the ends 20 of the bows. The covering material 2 being resilient will seal over the holes made by the nails 21, so that the nail holes will not be visible in the final product.

The blow-molded thermoplastic arm piece 1, as used in the invention, provides a substantial cost reduction over the conventional wood arm piece, as used in the past.

In addition, the inner side surface of the arm piece, which faces the rib cage of the user, can be contoured to accommodate the shape of the rib cage, thus providing greater comfort to the user of the crutch.

I claim:

1. An arm piece assembly for a crutch, comprising a polymeric arm piece having an outer side surface and an opposed inner side surface, said arm piece also having a top surface and a bottom surface, said bottom surface having at least one recess bordered by an internal recess wall and disposed to receive a bow of a crutch, said inner and outer side surfaces being in non-parallel relation, said inner side surface extending downwardly and away from the outer side surface, reinforcing means connecting at least one of said side surfaces to said recess wall to thereby reinforce said recess wall, and an outer covering of resilient material disposed on the outer side surface and the inner side surface and the top surface of said arm piece, said reinforcing means comprising a depression in one of said side surfaces, said depression being bordered by a depression wall, said depression wall interconnecting said one side surface and said recess wall.

2.The assembly of claim 1, wherein a central portion of the inner side surface is concave in a horizontal direction.

3. The assembly of claim 1, wherein said outer side surface is disposed generally perpendicular to said bottom surface, and said inner side surface extends at an angle of about 15°–20° with respect to said outer side surface.

4. The assembly of claim 3, wherein a central portion of the inner side surface is concave in a horizontal direction.

5. An improved arm piece assembly for a crutch, comprising a hollow, thermoplastic blow-molded arm piece having an outer side surface and an opposed inner side surface, said arm piece also including a top surface and a bottom surface, said top surface being generally concave, said outer side surface being generally normal to said bottom surface and said inner side surface extending at an angle of about 15°–20° with respect to said outer side surface, a central portion of said inner side surface being concave in a horizontal direction, attaching means for attaching the bows of a crutch to said arm piece, said attaching means comprising a pair of recesses formed in said bottom surface, each recess being bordered by a recess wall, each recess disposed to receive a bow of a crutch, and reinforcing means connecting at least one of said side surfaces to each recess wall, and an outer cover of resilient material bonded to the side surfaces, the top surface and the bottom surface of said arm piece, said reinforcing means comprising a depression in at least one of said side surfaces, said depression being bordered by a depression wall, said depression wall interconnecting said one side surface and said recess wall.

6. The assembly of claim 5, wherein said bottom surface includes a pair of end portions that lie in a common plane and a central, shallow concavity disposed between said end portions.

7. The assembly of claim 6, wherein said cover extends over said concavity, said end portions being free of said cover.

8. The assembly of claim 5, wherein each recess wall is generally cylindrical in configuration and the bottom of each recess is closed by a bottom wall.

9. The assembly of claim 5, and including a series of depressions disposed in said bottom surface, said resilient material disposed in said depressions.

10. A crutch construction comprising a crutch having a pair of generally parallel bows, and an arm piece assembly comprising a hollow thermo-plastic blow-molded arm piece having an outer side surface and an inner side surface, said arm piece also including an upper surface, a lower surface and a pair of end surfaces, said side surfaces, said end surfaces, said upper surface and said lower surface defining an internal closed cavity, said lower surface including a pair of spaced recesses, each recess bordered by an internal recess wall, said recess wall separating said recesses from said internal cavity, a depression in at least one of said side surfaces and bordered by a depression wall, said depression wall interconnecting said one side surface and said recess wall, each of said bows having an upper end and each upper end being disposed in one of said recesses, and fastening means extending normal to said side surfaces and through a recess wall and engaged with each upper end to lock the upper end within the respective recess.

11. The construction of claim 10, and including a resilient covering disposed around said arm piece and enclosing said depression, said fastening means comprising a headless nail disposed in said depression and having an inner end engaged with the end of said bow and an outer end located inwardly of the outer surface of said covering.

* * * * *